United States Patent [19]

Morrison et al.

[11] 4,210,324

[45] Jul. 1, 1980

[54] TIMER CONTROLLED GAME APPARATUS

[75] Inventors: Howard J. Morrison, Deerfield; John R. Wildman, North Riverside, both of Ill.

[73] Assignee: Marvin Glass & Associates, Chicago, Ill.

[21] Appl. No.: 876,407

[22] Filed: Feb. 10, 1978

[51] Int. Cl.[2] ..... A63F 7/00

[52] U.S. Cl. ..... 273/1 R

[58] Field of Search ..... 273/1 R, 1 E, 1 M, 120 R, 273/120 A, 144 A; 35/22 R, 22 A

[56] References Cited

U.S. PATENT DOCUMENTS

| | | | |
|---|---|---|---|
| 1,253,202 | 1/1918 | Barkow | 273/120 R |
| 1,295,504 | 2/1919 | Howard et al. | 273/120 R |
| 1,296,129 | 3/1919 | Siegel | 273/120 R |
| 2,336,773 | 12/1943 | Black et al. | 273/120 R |
| 3,592,472 | 7/1971 | Kent | 35/22 A X |
| 3,710,455 | 1/1973 | Liversidge et al. | 273/1 R X |
| 3,721,440 | 3/1973 | Burns | 273/1 R |
| 3,954,262 | 5/1976 | Weber | 273/1 E |
| 3,961,794 | 6/1976 | Goldfarb et al. | 273/1 R X |

*Primary Examiner*—Paul E. Shapiro

*Attorney, Agent, or Firm*—Mason, Kolehmainen, Rathburn & Wyss

[57] ABSTRACT

A game apparatus providing a challenge or test of manipulative skills to be performed within a predetermined time period, the length of which may be partially controlled by the operator. The apparatus provides a timed, sequential release of color coded playing pieces which traverse an inclined path of travel to be manually captured by the player of the game. The player attempts to deposit the playing pieces in particular locations in a depository array as dictated by one of a plurality of playing cards including indicia associated with the color coded playing pieces. The depository array includes a plurality of subsets, each of which includes an ejector mechanism, which, upon actuation, ejects the playing pieces deposited within that particular subset. Each particular subset of the depository array is associated with a timing mechanism so that the actuation of the associated ejector mechanism can be successfully delayed by skillful operation of a plurality of delay control devices. The playing piece ejectors of all of the depository array subsets are actuated after the last of a predetermined number of playing pieces have been released. This ejector actuator can be successfully disabled after completion of the array by deactivation of the times as dictated by the rules of the game.

20 Claims, 6 Drawing Figures

10
30
32
34
236
234
230
232
240
22a
22b
22c
170a
170b
170c
172a
172b
172c
182
130a
130b
130c
134a
134b
134c
138a
138b
138c
242
132a
132b
132c
190a
190b
190c
192a
192b
192c
198a
198b
198c
196a
196b
196c
200a
200b
200c
202
204
208
158
144
140
142
246
250
82
F
80
120
122
70
72
150
100
112
108
106
104
102
116
240
A
D
E
50
20a
20b
20c
52a
52b
52c
88a
88b
88c
84a
84b
84c
86a
86b
86c
60a
60b
60c
62a
62b
62c
54a
54b
54c
56a
56b
56c
90a
90b
90c
92a
92b
92c
58
76
78
74
T-3
T-4

TIMER CONTROLLED GAME APPARATUS

BACKGROUND OF THE INVENTION

1. Field of the Invention

This invention relates to game devices and more particularly to a game apparatus which provides a race, or test of manipulative skills, against the clock.

2. Brief Description of the Prior Art

Many devices or games have been provided in the past, in which the object of the game is to complete a certain task, such as the assembly of a two or three dimensional puzzle. These games have been well received since they provide much enjoyment by the players, and can be played by a number of players simultaneously. In addition, other types of games have provided a set task which must be completed within a given time period. Often, this time period is determined by an integral or self-contained timer which signifies the end of the particular period by dislodging the puzzle pieces from a predetermined or preferred alignment. The present invention provides a new and exciting game apparatus requiring a particular player to achieve or assemble playing pieces within a predetermined time period.

SUMMARY OF THE INVENTION

An object of the present invention therefore is to provide a new and entertaining game apparatus providing a challenge or test for the player to be completed within a given time period.

In accordance with this and other objects of the present invention, the game apparatus disclosed herein provides a timed, sequential release of color coded playing pieces which traverse a path of travel and are manually retrieved by the player to be placed in predetermined positions within a playing piece depository array. The alignment of the color coded playing pieces within the array varies from player to player in accordance with the rules of the game which provide a plurality of playing cards each having indicia associating the color coded playing pieces with definitive positions within the depository array. Ejector means for each portion of the depository array will eject the playing pieces deposited therein upon actuation by a timing mechanism. Each portion of the ejector means is associated with an individual delay control means so that timely actuation of the control means can delay the actuation of the associated ejector means. The ejector means along the depository array portions are finally actuated after the last of a predetermined number of color coded playing pieces has been released, however, the actuation thereof can be successfully prevented after successful placement of the playing pieces within the depository array by deactivation of the timing means.

Other objects, features and advantages of the invention will be apparent from the following detailed description taken in connection with the accompanying drawings.

DESCRIPTION OF THE PREFERRED EMBODIMENT

Figure 1:
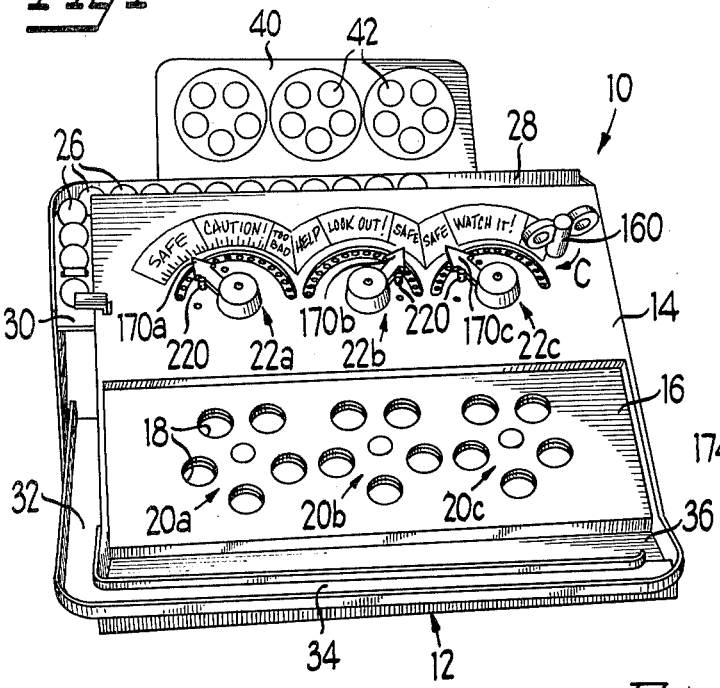
FIG. 1 is a perspective view of a game apparatus made in accordance with the concepts of the present invention.
Figure 6:
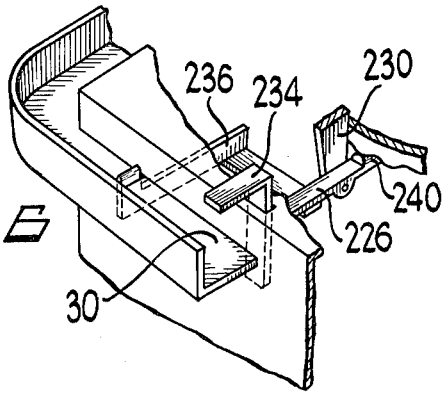
FIG. 6 is a perspective view of the playing piece release mechanism.

A game apparatus made in accordance with the concepts of the present invention is shown in FIG. 1 and generally designated by the reference numeral 10. The game apparatus 10 includes a frame 12 defining an upwardly canted deck 14. The deck 14 includes, in a recessed lower area 16, means defining a depository array comprising a plurality of openings or apertures 18 each arranged in one of three circular subsets **20*a*, 20*b* and 20*c*. An associated delay control device 22*a*, 22*b* and 22*c* is associated with one of the depository subsets 20*a*–20*c*, respectively. The game apparatus 10 further includes a plurality of playing pieces 26, which in the preferred embodiment, comprise a plurality of color coded balls or marbles 26. The playing pieces 26 are shown positioned in a peripheral trough 28 about the deck 14 which is inclined downwardly from the right to the left across the top, and downwardly along the side of the deck for a short portion 30 (FIGS. 1 and 6). The end of the trough 30 will drop the playing pieces onto a lower trough portion 32 on the left of the panel 14 which again directs the balls downwardly into the lower portion of the trough 34 which is inclined downwardly from left to right across the front or bottom of the panel 14 which terminates and deposits the playing pieces 26 into a receiving area 36, generally below the recessed surface 16. Once the playing pieces enter the area 36, they may be captured or picked up by the players of the game for depositing within the apertures 18. Each of the apertures 18 is of a diameter slightly smaller than that of the playing pieces 26 so that a ball will rest within an aperture 18** due to gravitational forces.

As described above, the playing pieces 26 are color coded and must be placed within the apertures 18 according to a predetermined pattern defined by one of a plurality of playing cards 40 (FIG. 1) which defines the respective alignments of the playing pieces. The indicia 42 on the cards 40 defines a position for one of the playing pieces 26 in the apertures 18. Each of the plurality of playing cards provide different combinations or goals to be achieved by the players of the game, and, so can be seen in the preferred embodiment, provide definite locations for fifteen color coded playing pieces. At the beginning of play of the game, the playing pieces 26 are randomly loaded within the trough 28, preferably before the playing card 40 is chosen, and a last or sixteenth "black" playing piece is placed at the end, at the uppermost portion of the trough.

Figure 3:
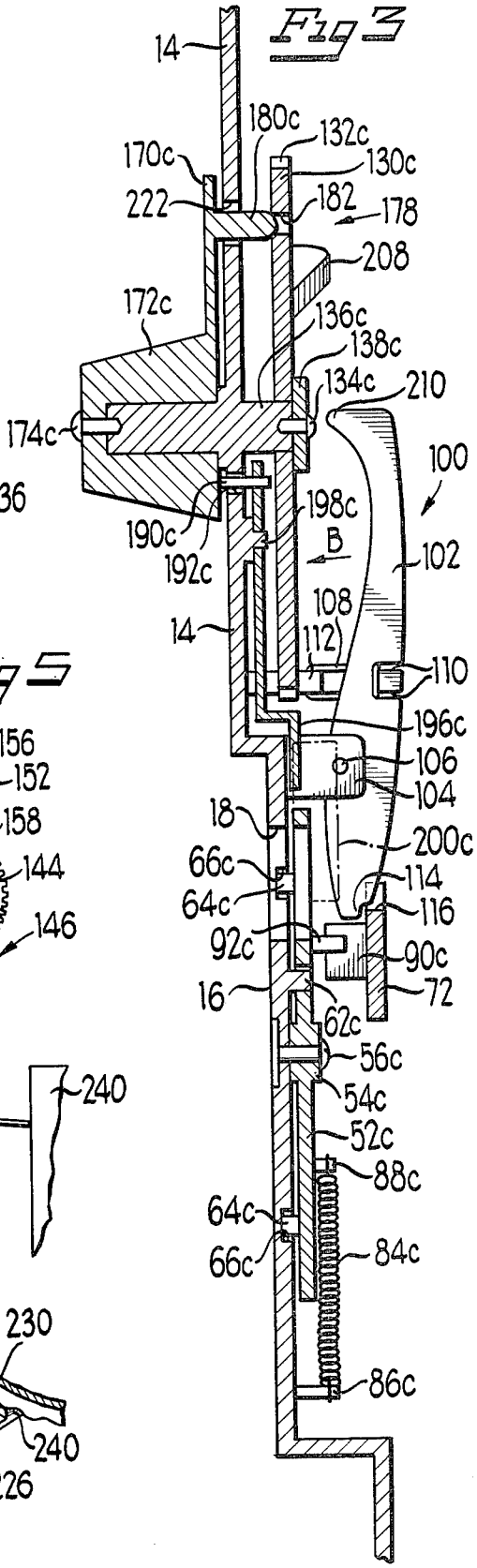
FIG. 3 is a vertical section, taken generally along line 3—3 of FIG. 2.
Figure 4:
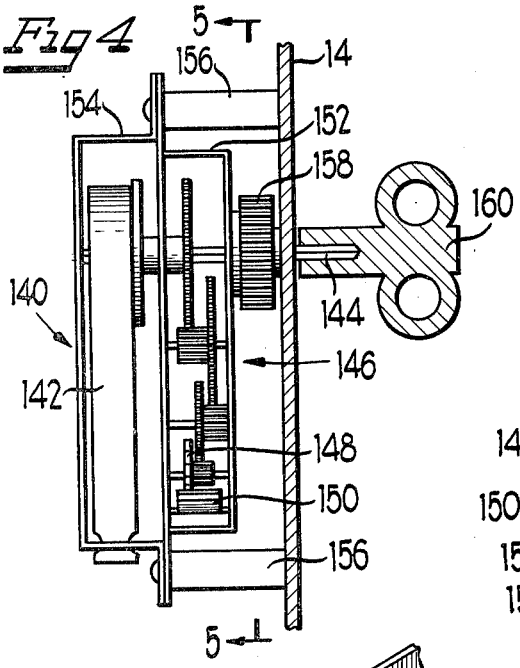
FIG. 4 is another vertical section, taken generally along line 4—4 of FIG. 2.
Figure 5:
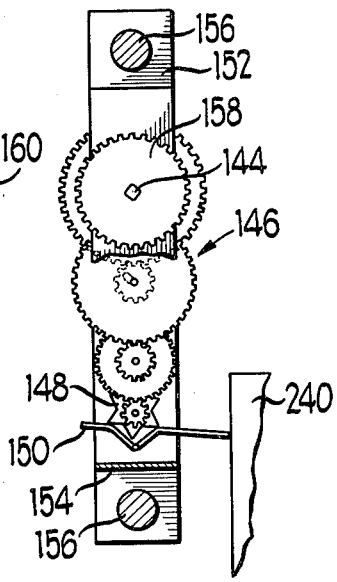
FIG. 5 is another vertical section, taken generally along line 5—5 of FIG. 4.
Figure 2:
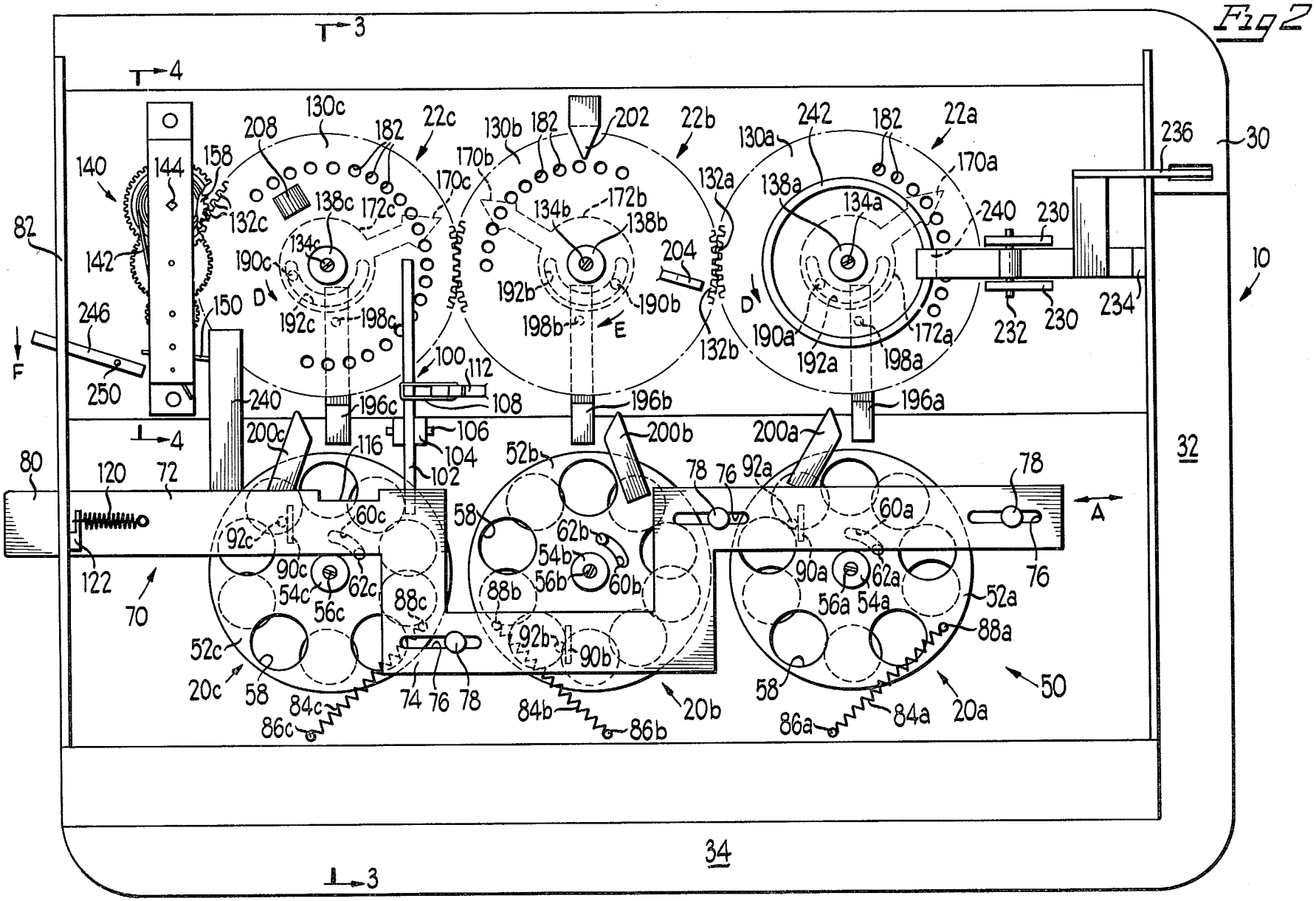
FIG. 2 is a rear plan view, on an enlarged scale, of the game apparatus of FIG. 1.

More particularly, referring to FIG. 2, the game apparatus 10 includes ejector means 50 for ejecting the playing pieces 26 from the apertures 18. Specifically, each subset **20*a*–20*c* includes an ejector disc 52*a*, 52*b* and 52*c*. The discs 52, referring to FIG. 3, are mounted by a central hub 54 and pin 56 at the center of each of the circular patterns formed by the holes 18. Each disc 52, in the preferred embodiment, includes five apertures 58 alignable with the apertures 18 in the surface 16. Thus, as will be described in detail hereinafter, during the play of the game, the discs 52 are positioned to be in alignment with the apertures 18 as shown in FIG. 1 so that the playing pieces 26 may be placed within the apertures 18. The ejector means 50 is operable to eject the balls from the apertures 18 by rotation of the discs 52 relative to the surface 16 which, in effect, closes the apertures 18 and ejects the playing pieces 26 into the collection area 36**.

The degree of angular rotation of each of the discs 52 is limited by an arcuate slot 60 and a pin 62 secured to the rear of the surface 16. In addition, to facilitate rotation, an extension 64 rides within an arcuate trough 66 cut approximately through the diameters of the apertures 18 again, in the rear side of the recessed surface 16.

Two independent means are provided for actuating the ejector means 50. Particularly, a first ejector actuating means, generally designated 70, is provided to simultaneously actuate all three of the ejector discs 52. The ejector actuator 70 includes a generally horizontal slide plate 72 which includes a downward offset portion 74 as shown in FIG. 2. The slide plate 72 is mounted by a plurality of slots 76 and shoulder screws 78 for horizontal movement back and forth, generally in the direction of arrows A. To the left, as shown in FIG. 2, an extended portion 80 of the plate 72 extends through a slot in the side wall 82, which would be on the right of the game apparatus 10 as shown in FIG. 1. FIG. 2 shows the initial and final positions of the ejector discs 52 in which, each of the apertures 18 is substantially closed by the respective discs to prevent any of the playing pieces from staying within the apertures 18. During operation, for the play of the game, the discs are rotated so that the apertures 58 are in alignment with the apertures 18 so that the playing pieces will rest within the apertures. To this end, each of the discs 52 is biased by a spring **84*a*–84*c* connected to a post on the wall 16, and a similar post 88 on the disc 52. The springs 84*a* and 84*c* bias the discs 52*a* and 52*c* in a clockwise direction as shown in FIG. 2 while spring 84*b* biases the disc 52*b* in a counterclockwise direction. To begin the play of the game, the plate extension 80 is depressed, moving the plate 72 to the right in FIG. 2. The plate 72 carries three forwardly directed tabs 90*a*, 90*b* and 90*c* which engage associated pins 92*a*, 92*b* and 92*c* on the respective discs 52 under the force of the springs 84. As the plate 72 is moved to the right, the discs 52 are permitted to rotate under the force of the spring 84 to the position as shown in FIG. 1** wherein the apertures are in alignment.

A locking means or stop means, generally designated 100, comprises a lever 102 mounted between a pair of ears 104 by a pin 106 for pivotal movement. Referring to FIG. 3, the top of the lever 102 is biased in the direction of arrow B by a rubberband 108 secured between slots 110 and a hook 112 on the panel 14. The biasing force moves a notch 114 on the bottom of lever 102 into engagement with a similar notch 116 on the plate 72 thus maintaining the lever 72 in its righthand position while maintaining the discs 52 with their apertures 58 in alignment with the apertures 18. The plate 72 is biased to the left, as shown in FIG. 2, by a spring 120 secured to a hook 122 on the side wall 82. As will be described hereinafter, after a predetermined period of time, the plate 72 is permitted to move to the left under the force of the biasing spring 120 by rearward pivotal movement of the top of lever 102, in the direction opposite that of Arrow B, thus closing all of the apertures 18 and ejecting any of the playing pieces 26 therewithin.

The delay control devices **22*a*–22*c*, referring to FIG. 2, are mounted directly above the associated ejector discs 52*a*–52*c* and serve as a means for actuating the associated ejector disc prior to its eventual actuation by the slide plate 72 as described above. More specifically, the delay devices 22 each include a disc 130 having a peripheral edge defined by gear teeth 132. The discs 130 are mounted in a horizontal row for rotation by a screw 134 on a rearwardly directed boss 136. Each disc includes a shoulder 138 to facilitate actual alignment on the boss 136. The gear teeth 132 of the respective gears 130 are in meshing engagement so that the outer two gears 130*a* and 130*c* rotate in one direction while the inner gear 130*b* rotates in an opposite direction. The gear on the left, as shown in FIG. 2, is in meshing engagement with a drive means, generally designated 140. The drive means 140 comprises a conventional spring wound motor which is commonly known in the state of the art. A spring 142 drives a square shaft 144. The release of the stored energy in the spring 142 is slowed by a gear train 146 which terminates in a star gear 148 engaging a pivotally mounted release lever 150. The release lever 150 regulates and slows the speed of the shaft 144 and also serves as a motor stop since, the lever 150 must be free to pivot in order to allow the motor to run. The motor 140 is mounted within a frame 154 to a pair of rearwardly directed posts 156 on the panel 14. The square shaft 144 carries a gear 158 which engages the gear teeth 132*c* of the disc 130*c* to simultaneously drive the three discs. The square shaft 144 extends through the panel 14 and is wound by a key 160 by turning the key in a clockwise direction as shown by arrow C in FIG. 1. Thus, when the spring motor runs, the output gear 158 drives the outer gears 130*a* and 130*c* in a counterclockwise direction as shown by arrow D in FIG. 2, while the central disc 130*b*** rotates in a clockwise direction as shown by arrow E.

Referring again to FIG. 3, each of the delay mechanisms 22 includes a pointer 170 mounted by a hub or manual knob 172 for rotation about a forward extension of the journal 136 by a set screw 174. Each of the pointers 170 can thus be rotated independently and relative to the associated disc 130 mounted on the opposite side of the panel 14. However, a detent means 178 in the form of a rearwardly extended protrusion 180 on each of the pointers 170 and a plurality of small apertures 182 tend to rotate the pointers conjointly with the discs 130 under the influence of the drive motor 140. Thus, the pointers will rotate in the same direction as the discs 130 but can be rotated relative to the disc by overcoming the frictional force of the detent means 178. The ability of the operator to rotate the pointers 170 relative to the discs 130 permits that player to delay the secondary ejector means from premature ejection of the playing pieces 26 from the apertures 18.

More specifically, the hub portion 172 of each delay mechanism includes a rearwardly directed pin 190 which extends through an arcuate slot 192 in the panel surface 14 to a point generally adjacent but short of the inner surface of the disc 130. As can be seen from FIG. 2, the arcuate slot **192*c* extend approximately 180°. Referring to FIG. 2, a pivotal ejector actuator 196 is mounted for pivotal movement on the rear surface of the panel 14 by a shoulder pivot pin 198 so that its top end, referring to FIG. 3, is in the path of travel of the actuator pins 190 on the hubs 172. Thus, as the pointer rotates with the gear 130, the pins 190 will rotate in the same direction and engage the top end of each actuator 196. Each of the discs 52 includes an actuator contact plate 200 which includes a canted surface which extends generally vertically during the operative position of the disc as shown in FIG. 1. As the actuator pin 190 engages the actuator 196, the pivotal movement thereof contacts the surface 200 and thus automatically and quickly pivots the associated disc 52 in the direction against the force provided by the biasing spring 84 thus closing the apertures 18 and ejecting the balls 26** prior to the end of the predetermined time period.

The predetermined time period is defined as one revolution of the central upper disc **130*b* as follows. A stop pointer 202 is provided at the top centerline of the center disc 130*b* and the disc itself carries a rearwardly extending tab 204 which engages either side of the pointer 202. When the key 160 is wound at the beginning of the game, the tab 204 contacts the pointer 202 on the surface on one side and the disc 130*b* is free to rotate in a clockwise direction, as shown in FIG. 2, until the tab 204 contacts the opposite side of the pointer 202. Simultaneously, and just prior to the termination of rotation of the discs 130, the slide plate 72 is released by the lever 102 to move to its preset position under the force of the biasing spring 120. To this end, an actuator cam 208 is provided on the rear exposed surface of the disc 130*c* so that as the tab 204 approaches the pointer 202, the cam surface 208 will engage the top cam surface 210 of the lever 102, thus pivoting the lever in a direction opposite that of arrow B and freeing the plate 72 for movement to the left in the direction of arrow A as shown in FIG. 2. As described previously, the contact plates 90 through pins 92 on the aperture discs 52 causes all of the discs to rotate to the position as shown in FIG. 2 and to eject the playing pieces 26. However, as previously described above, each of the individual actuating levers 196 may have previously pivoted the associated discs 52*a*, 52*b* or 52*c*** to its position as shown in FIG. 2.

Thus, as described above, the delay devices 22 permit the players, through the rotating of the pointers 170, to prevent actuation of the secondary or auxiliary ejector means until the end of the predetermined time period is defined by movement of the slide plate 72. Specifically, referring to FIG. 1, during operation of the drive motor 140, and the manual and manipulative attempts of the player to place the playing pieces 26 within the open apertures 18, a player can prevent the pin 190 from engaging the actuator 196 by sequentially rotating the respective pointer relative to the discs 130 by overcoming the force of the detent means 178. The direction of rotation of the discs 130 are defined by arrows D and E, thus, referring to FIG. 1, a player would attempt to maintain the arrows **170*a* and 170*c* at approximately the ten o'clock position as shown in FIG. 1 while attempting to maintain the pointer 170*b* in approximately the two o'clock position as shown. A plurality of stop pins 220 limit the rotation of the pointers in the preferred direction. The posts 180 extend through the arcuate slots 222 which extend approximately 180° across the top of the control knobs 172. To facilitate identification of the proper or favorable pointer direction, indicia such as the safe area markings, and caution or danger area markings are provided on the panel 114. A final "help" area is designated when the pins 190 are just about to actuate the levers 196. Thus, in combination with attempting to place the playing pieces 26 within the apertures 18, according to the color code defined by the cards 40, a player must attempt to prevent actuation of the secondary ejector means to maintain or prevent ejection of the correctly placed playing pieces 26. Note that it is not possible to place all of the playing pieces 26 within the appropriate apertures 18 without successful operation of the delay devices 22 since the playing pieces 26 are not released all at one time, but only sequentially during the rotation of the discs 130. Note that the pointers 170 can only be rotated through an angle of approximately 160° and yet the discs 130 rotate approximately 360° during the total play of the game or unwinding of the spring motor 140**.

Referring to FIG. 6, the seriatim release of the playing pieces 26 from the end of the chute 30 is accomplished by a release lever 226 pivotally mounted by a pair of ears 230 and a pin 232 to the back of the panel 14. The release arm carries an upwardly extending L-shaped member 234 which contacts the first ball on the trough 30 and prevents its escape until the L-shaped member is raised. Simultaneously, with the raising of the L-shaped member 234, and L-shaped flange 236 is raised just prior to the second ball as shown in FIG. 1, to maintain all of the other playing pieces within the trough 30. When the L-shaped member 234 again moves downwardly, the L-shaped flange 236 permits the second ball to move forward where it is stopped until the cycle is repeated again. The release lever 266 carries on its inner end a cam surface 240 which rides on an annular generally sinusoidal cam surface 242 so as to maintain the release arm 226 in constant motion. Preferably, the cam surface 242 contains approximately 16 lobes which will sequentially release the fifteen playing pieces plus the last "black" marble which signifies that the predetermined time period is almost at an end.

To start the play of the game, the player randomly deposits the playing pieces 26 in the trough 30 and selects one of the playing cards 40 which defines the arrangement that the playing pieces 26 must take in the apertures 18. The key 160 is then wound to rotate the discs 130 approximately one full revolution. The stop pins 220 hold the pointers 170 in the safe location while the discs 130 rotate relative thereto. Care must be taken to prevent the playing pieces 26 from escaping since the release mechanism of FIG. 6 would be actuated during the winding of the disc **130*a*. To prevent the motor 140 from beginning to operate immediately upon release of the key 160, a stop tab 240 is provided to engage the pivotal lever 150. The stop tab 240 is secured to the slide arm 72 and maintains the motor 140 in a static condition. Upon depression of the extension 80, the tab 240 releases the pivotal lever 150 thus causing the motor to operate and the discs 130 to rotate. The horizontal movement of the slide plate 72 opens the apertures 18 by rotating the discs 52 and the operation of the cam 242 begins to sequentially release the playing pieces 26. The player then attempts to place each of the released balls in an appropriate aperture 18 corresponding with the color code of the playing card 40 while taking care to maintain the pointers 170 in a position to prevent premature actuation of the secondary ejection mechanism. In the preferred embodiment, a stop lever 246 is pivotally mounted by a pin 250 adjacent the pivotal lever 150 of the motor so that after successful placement of all of the playing pieces 26 within the apertures 18, a player can stop the motor 140 by pivoting the lever downwardly as shown by arrow F, thus bringing the other end of the lever 246 into engagement with the pivotal lever 150 to the motor to stop the timer and prevent release of the slide plate 72 by actuation of the lock lever 102. It is contemplated that many variables can be provided, such as a cam 242** including additional lobes which will cause early release of the playing pieces to permit more time for a player, such as a young child, to attempt to complete the depository array with the playing pieces. This, and other modifications would be apparent to one skilled in the art. Therefore, the foregoing detailed description should be considered as having been given for clearness of understanding only and no unnecessary limitations should be understood therefrom as many modifications will be obvious to those skilled in the art in light of the foregoing disclosure.

We claim:

1. A game apparatus, comprising:
a frame having means defining a playing piece path of travel;
a plurality of playing pieces;
release means for sequentially releasing playing objects onto said playing piece path of travel;
a depository array for receiving said playing pieces whereby the playing pieces can be manually moved from the path of travel to the depository array; and
blocking timing means defining a period of time in which said playing pieces may be received in said array.

2. The game apparatus of claim 1 wherein said playing objects are color coded.

3. The game apparatus of claim 2 including identifying means defining a set of depository array positions for receiving particular ones of said color coded playing pieces.

4. The game apparatus of claim 3 wherein said identifying means comprises a plurality of cards defining the positions of said color coded playing pieces within said depository array.

5. The game apparatus of claim 4 wherein said playing pieces are balls.

6. The game apparatus of claim 1 wherein said playing piece path of travel is a chute directing the playing pieces from one elevation to a generally lower elevation.

7. The game apparatus of claim 1 wherein said depository array includes a plurality of array subsets.

8. A game apparatus, comprising:
a frame having means defining a playing piece path of travel;
a plurality of playing pieces;
release means for sequentially releasing playing objects onto said playing piece path of travel;
a depository array including a plurality of array subsets whereby the playing pieces can be manually moved from the path of travel into the depository array subsets; and
a playing piece ejection means for each of said depository array subsets.

9. The game apparatus of claim 8 wherein said depository array subsets each include a plurality of apertures in the frame for receiving said playing pieces.

10. The game apparatus of claim 9 wherein said ejection means comprises a planar element having apertures alignable with said depository array, said planar element being mounted for movement relative to said frame for ejection of said playing pieces as said element moves relative to said frame.

11. The game apparatus of claim 10 wherein said release means causes actuation of said ejection means after a predetermined period of time.

12. The game apparatus of claim 11 wherein said predetermined interval is independently variable for each subset portion of said depository array.

13. A game apparatus, comprising:
a frame having means defining a depository array;
a plurality of playing pieces;
means defining specific positions within said depository array into which particular ones of said playing pieces are to be located;
first variable playing piece ejection means for ejecting playing pieces from said depository array; and
secnd playing piece ejection means for ejecting said playing pieces from said depository array independent of said first variable playing piece ejection means.

14. The game apparatus of claim 13 wherein said depository array includes a plurality of apertures in the frame for receiving the playing pieces.

15. The game apparatus of claim 14 wherein both of said ejection means include as common elements the planar element having apertures therein alignable with said depository array apertures and said planar element is mounted for movement relative to said frame for ejection of playing pieces as the element moves relative to said frame.

16. The game apparatus of claim 15 wherein said first variable ejection means includes a rotatable element for actuation of said planar element to eject said playing pieces.

17. The game apparatus of claim 16 including a planar element actuator secured to said rotatable element and movable relative thereto to permit delayed actuation of the ejector means by relative rotation thereof with respect to said rotatable element.

18. The game apparatus of claim 16 wherein said second ejection means comprises an actuator for actuating said planar element independently of said rotatable element.

19. The game apparatus of claim 18 including a plurality of subsets of said depository array and a planar element associated with each of said subsets.

20. A game apparatus, comprising:
a frame having means defining a playing piece path of travel;
a plurality of playing pieces;
release means for sequentially releasing playing pieces onto said playing piece path of travel;
a depository array for receiving said playing pieces whereby the playing pieces can be manually moved from the path of travel to the depository array; and
means for providing a variable interval of time for manually positioning said playing pieces within said array.

* * * * *